United States Patent [19]

Debetencourt

[11] Patent Number: 4,884,705

[45] Date of Patent: Dec. 5, 1989

[54] POURER PLUG FOR A RECEPTACLE

[75] Inventor: Jean Debetencourt, Maulde, Belgium

[73] Assignee: Lynes Holding S.A., Luxembourg, Luxembourg

[21] Appl. No.: 224,321

[22] Filed: Jul. 26, 1988

[30] Foreign Application Priority Data

Jul. 27, 1987 [BE] Belgium ..... 08700829

[51] Int. Cl.[4] ..... B65D 41/50

[52] U.S. Cl. ..... 215/250; 222/83

[58] Field of Search ..... 222/83, 81, 91; 215/250, 232

[56] References Cited

U.S. PATENT DOCUMENTS 4,754,889 7/1988 Debetencourt ..... 215/250 X 4,760,941 8/1988 Salmon et al. ..... 222/83 X

FOREIGN PATENT DOCUMENTS 1152931 5/1969 United Kingdom ..... 222/83

*Primary Examiner*—Donald F. Norton

*Attorney, Agent, or Firm*—Fleit, Jacobson, Cohn, Price, Holman & Stern

[57] ABSTRACT

The invention relates to a pourer plug device for a receptacle having a neck which is equipped with a thermosealed lid, and comprising a plug element and a cap with a pourer aperture, characterized in that the plug element (4) comprises in its center a cylindrical core (10) which presents at its base a curing knife (14) which is able to punch said lid (2) when said cylindrical core (10) is axially displaced towards said lid (2) in response to the cap (7) being displaced towards the lid (2).

10 Claims, 3 Drawing Sheets

POURER PLUG FOR A RECEPTACLE

The invention relates to a pourer plug device for a receptacle having a neck which is equipped with a thermosealed lid, and comprising a plug element and a cap with a pourer aperture, which cap can be moved with respect to the plug element, said device further comprising a guarantee or inviolability strip which can be pulled off said cap and which, as long as it has not been pulled off, serves to forbid movement of the cap relative to the plug.

The object of the invention is to realize a pourer plug device which offers a guarantee of non-deterioration of the packed products and an easy means for the user to punch a sealing lid incorporated therewith, wherein no particular manipulations are needed in order to pass the receptacle, equipped with the device according to the invention, from the stage of "sealed under guarantee" to the "utilization" stage.

In order to realize that object, the invention is characterized in that the plug element comprises in its center a cylindrical core, which, when the device is closed, seals said cap pourer aperture by means of its top and presents on its base a cutting knife which is able to punch said lid when said cylindrical core is axially displaced towards said lid by means of the pressure exerted by the cap when it is rotated in order to be displaced towards said lid, the cylindrical core being on the one hand guided at one extremity with respect to said cap and on the other hand linked by the other extremity to the base of the plug element by means of flexible spacer strips which form hinges, and which are obliquely oriented between the base of the plug element and the core and which cannot return the cylindrical core to its initial position after it has been displaced a maximum amount of its travel towards said lid.

Further according to the invention, said flexible spacer strips initially are oriented obliquely with respect to the direction of the geometrical axis of said cylindrical core, and extend away from the base of the plug element and from said sealed lid of said receptacle, and the plug element base, the spacer strips and said cylindrical core are made of a same material and the thickness of said spacer strips is sufficiently small in order to enable their bending and to allow their displacement, starting from an initial position, towards said lid of said receptacle and to oppose return of the core towards its initial position.

Other details and advantages will be set out in the description, given hereunder, of a pourer plug according to the invention. That description is only given by way of example and does not limit the invention. The reference numbers relate to the figures joined herewith.

Figure 1:
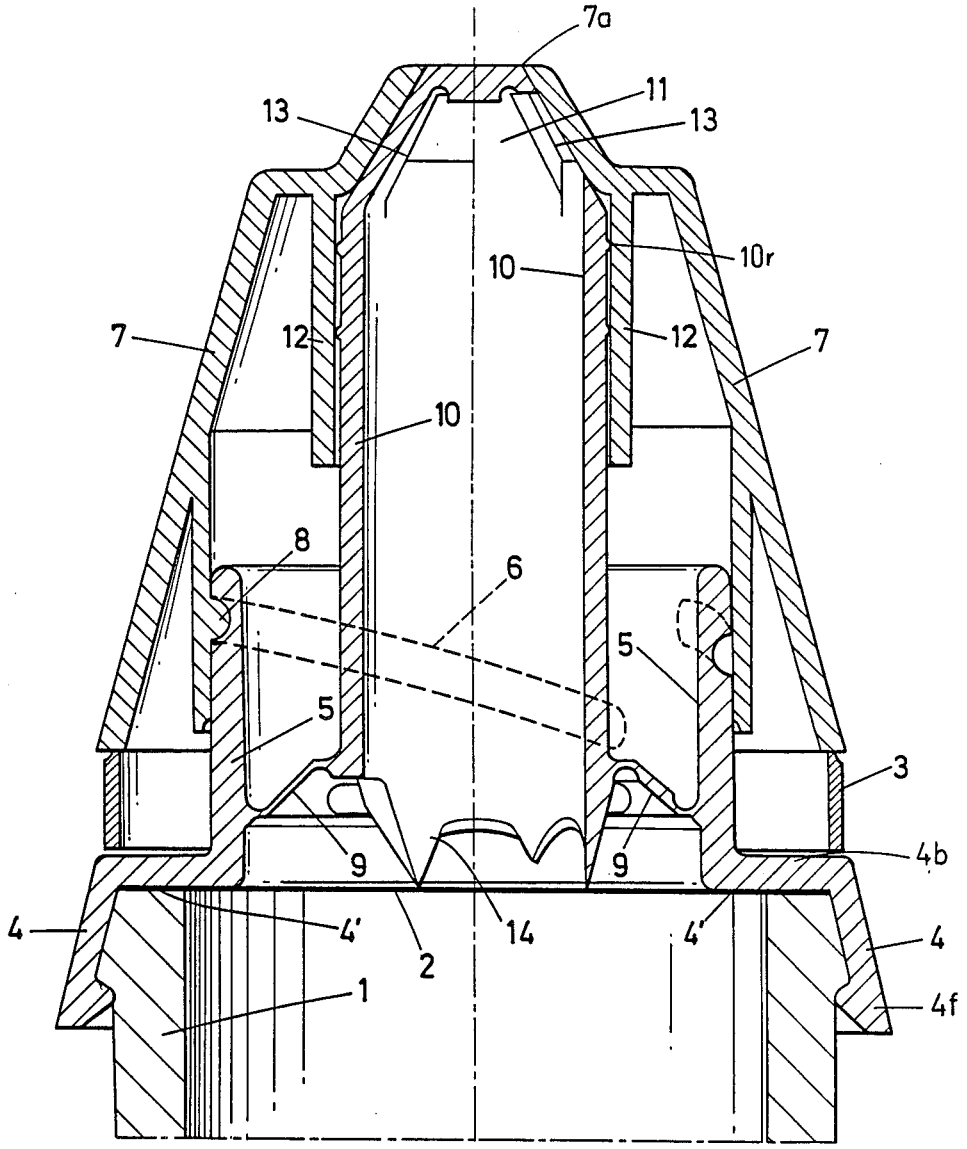
FIG. 1 shows a cross section of a pourer plug device according to the invention at its original stage when the cap is still equipped with its guarantee strip.

FIG. 1 represents the device locked on the neck 1 of a receptacle provided with a lid 2 which is thermosealed on the neck 1 of the receptacle and also on a plug element of the pourer plug device according to the invention.

As represented in this figure, the lid 2 has not been punched and can not be punched as long as the guarantee strip 3 has not been pulled off.

The pourer plug device according to the invention comprises what will be called hereafter a plug element 4 and which, at its lower end, includes a fixing or securing flange 4*f*, enabling the fixing thereof on the neck 1 of the receptacle.

The plug element 4 comprises a cylindrical crown 5 on a plug element base 4*b*, which comprises at least two, but preferably three, cam-ways 6, enabling an axial displacement of a rotatable cap 7 which in its interior comprises two, but preferably three, hemispherical, helically-shaped ribs 8. After pulling off the guarantee strip 3, which is part of the cap 7, a downward displacement of the rotatable cap is possible.

The crown 5 of the plug element 4 is connected by means of a series of flexible spacer strips 9 to a cylindrical core 10, which also is part of the plug element 4 and which is guided in a cylindrical guide 12 of the cap 7 by means of annular ribs 10*r* on the core adjacent a top 11 thereof.

The top 11 of the cylindrical core 10 presents a series of pouring slits or openings 13 which enable the product contained in the receptacle to escape therefrom when the cap 7, which has an oblique, frustoconical top which corresponds (mates) with the top 11 of the cylindrical core, when the cap top is no longer in contact with the top of the core. The cap 7 is open at its upper part in order to form a pourer aperture 7*a*.

A characteristic of a device according to the invention is the conception of a hinged link formed by means of the flexible spacer strips 9 between the base of the cylindrical core 10 and the crown 5 on the base 4*b* of the plug element 4. By spacer strips is meant the parts of an element having the form of a diaphragm which parts join the cylindrical crown 5 to the cylindrical core 10.

Figure 2:
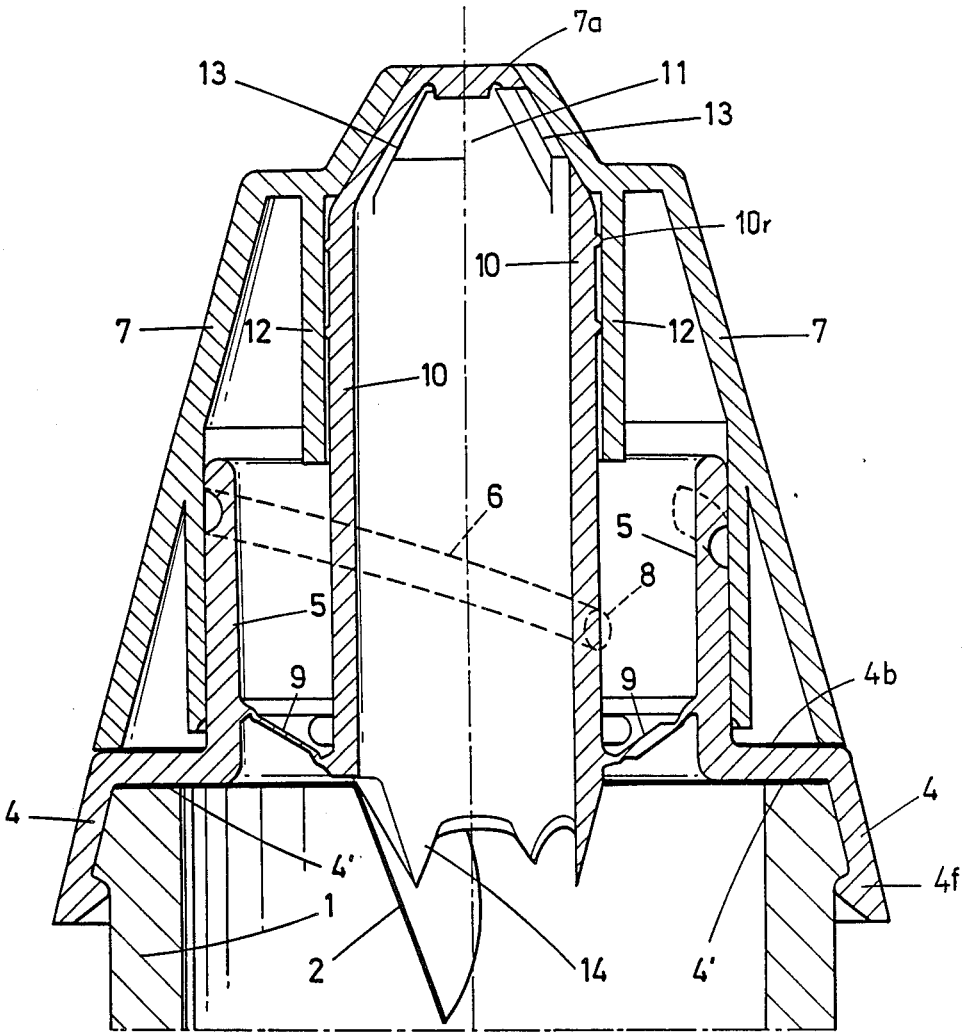
FIG. 2 shows a cross section of a same device in the position in which the lid has been punched, the pourer plug being closed.
Figure 3:
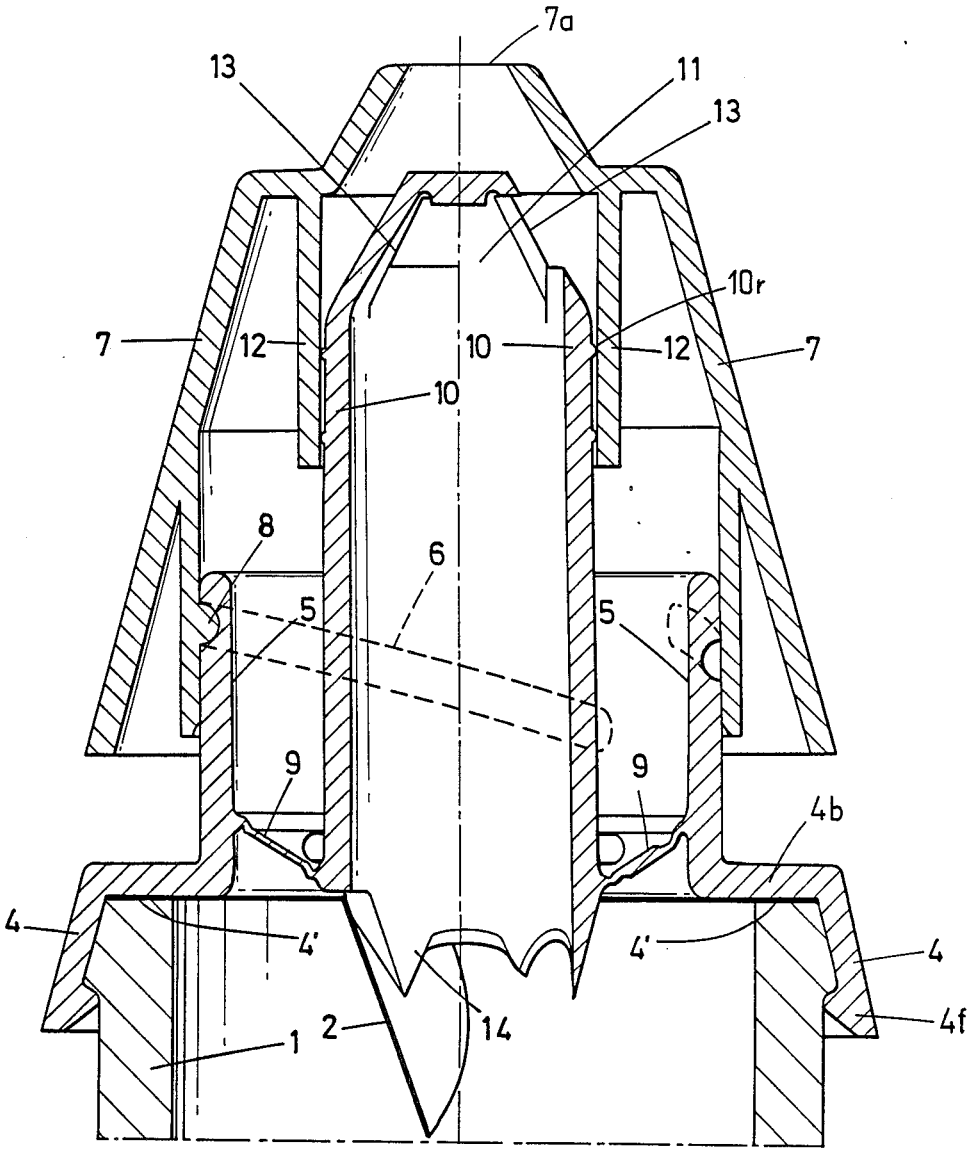
FIG. 3 shows a view analogous to the one given in FIG. 2, the pourer plug being open.

The entire plug element 4 preferably is formed of polypropylene, which allows enough flexibility to the spacer strips 9 forming the hinge, in order that the cylindrical core 10 can pass from the initial position, or starting position (as represented in FIG. 1), to a completely depressed position (as represented in FIG. 2) along a path which corresponds essentially to the height of the guarantee strip 3.

The use of polypropylene also provides enough rigidity, and thus enough cutting characteristics to the knife 14 of the cylindrical core 10, such that a displacement of the bottom of the cylindrical core 10 allows the knife 14 to cut, with a curved cutting tip, the thermosealed lid 2 on the neck 1 of the receptacle and on the lower side of the shoulder 4' of the plug element base 4*b*.

The profile of the teeth of the knife 14 is such that the lid 2 is not cut according to a full circle so that cut parts will thus not break off from the remainder of the lid.

When the cylindrical core 10 has been brought, by means of rotation of the cap 7, into its lowest position, the spacer strips 9, which act as a hinge, are naturally not able to return the cylindrical core back to its intial position.

The cutting or punching operation of the lid 2 can only be realized once, and only after the pull off of the guarantee strip 3. On the other hand, the cap 7 can be moved up or down, by means of rotation around its geometrical axis, thus enabling the opening or closing of the pourer aperture 7*a* provided at the top of the cap 7.

From the point of view of the user, the pourer plug device according to the invention can easily be handled and offers all guarantees of inviolability which can be needed. The manufacturing method and the assembling or mounting of the pourer plug device according to the invention, is extremely practical and it will be remarked that the hemispherical form of the ribs 8 allows an easy mounting of the cap 7 on the cylindrical crown 5 which is part of the plug element 4.

It is to be understood that the invention is not limited to the embodiment described hereabove by way of example and that a number of modifications could be applied without leaving the scope of the present invention.

What is claimed is:

1. A pourer plug device for a receptacle having a neck equipped with a sealed lid, and comprising:

a plug element including means for securing said plug element to the receptacle over the sealed lid;

a cylindrical core disposed at a center of said plug element;

cutting means on an inner end of said core, for cutting the sealed lid;

flexible means for mounting said core on said plug element securing means, for movement from an initial position toward the sealed lid so that said cutting means moves from an initial position into a cutting position in which said cutting means cuts the sealed lid; and a cap mounted for movement on said plug element, said cap being movable toward the receptacle from an initial position, to move said core and said cutting means to the cutting position, and said cap including a pouring aperture which is closed by an outer end of said core when said cap and said core are in their initial position, and which is opened when said cap is moved back to its initial position relative to said core after a sealed lid-cutting operation.

2. The device as claimed in claim 1, wherein said flexible means is a plurality of flexible spacer strips which initially are oriented obliquely with respect to the direction of a geometrical axis of said cylindrical core, and extend away from a base of said plug element and from the sealed lid, said spacer strips bending into an oblique orientation from said base toward the sealed lid when said core is moved into the cutting position, and said spacer strips then retaining said core and said cutting means in the cutting position.

3. The device as claimed in claim 2, wherein said plug element securing means, said plug base, said spacer strips and said cylindrical core are formed integrally of the same material.

4. The device as claimed in claim 3, wherein the material is polypropylene.

5. The device as claimed in claim 2, further comprising:

a cylindrical mounting portion on said base of said plug element;

helically-shaped rib-and-cam-way means on said cap and said cylindrical mounting portion, for mounting said cap for rotatable and axial movement on said cylindrical mounting portion;

an internal cylindrical guide portion on said cap and extending concentrically with respect to a geometrical axis of the device, for receiving and guiding a portion of said cylindrical core;

a guarantee strip disposed between said plug element and said cap, to prevent movement of said cap toward the receptacle until said strip is removed; and at least one pourer opening in said cylindrical core adjacent its outer end, said pourer opening being closed by said cap when said core and said cap are in their initial positions, and being opened when said cap is moved relative to said core after the sealed lid-cutting operation.

6. The device as claimed in claim 1, further comprising:

a cylindrical mounting portion on a base of said plug element; and helically-shaped rib-and-cam-way means on said cap and said cylindrical mounting portion, for mounting said cap for rotatable and axial movement on said cylindrical mounting portion.

7. The device as claimed in claim 1, wherein said cap includes an internal cylindrical guide portion extending concentrically with respect to a geometrical axis of the device, for receiving and guiding a portion of said cylindrical core.

8. The device as claimed in claim 1, wherein said sealed lid is joined to the neck of the receptacle and said plug element.

9. The device as claimed in claim 1, further comprising:

a guarantee strip disposed between said plug element and said cap, to prevent movement of said cap toward the receptacle until said strip is removed.

10. The device as claimed in claim 1, wherein said cylindrical core also includes at least one pourer opening adjacent its outer end, said opening being closed by said cap when said core and said cap are in their initial positions, and being opened when said cap is moved relative to said core after the sealed lid cutting operation.

* * * * *